United States Patent [19]

Lichy

[11] 4,379,478

[45] Apr. 12, 1983

[54] FOLDING OVERHEAD DOORS

[76] Inventor: Dale Lichy, 4651 Sylvan Dr., Allison Park, Pa. 15101

[21] Appl. No.: 157,951

[22] Filed: Jun. 9, 1980

[51] Int. Cl.[3] ..... E06B 3/00

[52] U.S. Cl. ..... 160/35; 160/229 R

[58] Field of Search ..... 160/35, 36, 37, 207, 160/192, 193, 196 D, 197, 201, 202, 203, 189, 165, 136, 220, 222, 229 R, 36, 37, 206

[56] References Cited

U.S. PATENT DOCUMENTS

| | | | |
|---|---|---|---|
| 437,597 | 9/1890 | Hicks | 160/37 |
| 475,611 | 5/1892 | Rosenthal | 160/220 X |
| 2,729,287 | 1/1956 | Goldner | 160/201 X |
| 3,021,896 | 2/1962 | Buono et al. | 160/201 X |
| 3,101,776 | 8/1963 | Voris | 160/207 |
| 3,280,888 | 10/1966 | Davis | 160/35 |
| 3,304,994 | 2/1967 | Kozak | 160/193 X |

FOREIGN PATENT DOCUMENTS

| | | | |
|---|---|---|---|
| 610054 | 3/1979 | Switzerland | 160/35 |

*Primary Examiner*—Peter M. Caun
*Assistant Examiner*—Cherney S. Lieberman
*Attorney, Agent, or Firm*—Buell, Blenko, Ziesenheim & Beck

[57] ABSTRACT

A folding overhead door assembly is provided having a guide means up of two superimposed oval channels on each side of a door opening, the channels having side-by-side vertical legs and spaced apart horizontal legs, a plurality of normally coplanar door sections mounted for movement at top and bottom of each side in one of said channels, and means pivotally attaching adjacent door sections together along like horizontal edge portions whereby the door sections remain in a substantially vertical plane from their coplanar position in a door opening to a side-by-side position on the spaced horizontal legs of the channels.

8 Claims, 10 Drawing Figures

FOLDING OVERHEAD DOORS

This invention relates to folding overhead doors and particularly to an overhead door assembly in which a plurality of horizontally elongated door sections are stored on edge overhead in planes generally parallel to the plane of the door opening.

Overhead doors have become almost universally used as closures in home garages as well as in commerical garages, warehouses and other installations where a closure is desired which stores out of the way. There are, however, situations where the headroom is such that a conventional overhead door and track cannot be used. In such circumstances overhead folding doors or roll up doors have been proposed. Typical of these prior art fold up doors are those illustrated in U.S. Pat. Nos. 2,834,411; 3,280,888; 3,344,837; 3,618,656; and 3,757,845. These prior art fold up doors are subject to several problems. The most significant of these problems are two problems related to the manner of storing the sections in the folded condition. The first of these problems arises from the fact that the folded sections are stored in a horizontal flat plane such that the bending moment of the door is resisted only by the thickness of the door. This requires that the door be much thicker and heavier in cross section or that it be supported by lengthwise support members to prevent the sections from sagging. The second major problem is related to the first and arises from the fact that the folded doors in the upper stored position must be held or supported in that position by a heavy spring or similar devices for holding the sections against falling. This is expensive and poses a continuing threat of accidental falling in the event of a failure of the spring or other holding device. Both of these problems are apparent in the prior art patents set out above.

The present invention is directed to a totally new concept in folding door construction in which the door sections are stored in side-by-side relationship in vertical planes so that the bending moment is resisted by the full width of the door sections rather than by the thickness. This permits the sections to be made in a lesser thickness, to be of greater widths and lighter in weight. Additionally the doors are stored on a horizontal rail section so that there is no tendency for the doors to fall and there is no requirement for a heavy spring or other holding means for supporting the entire weight of the door assembly in the folded position as is the case in the prior art. Finally, the present invention provides a new method of connecting the door sections so that conventional hinges are not used.

I provide a folding overhead door assembly comprising opposite side support and guide means defining a door opening therebetween, said side support and guide means including a first vertical track of generally ovoid shape having a lengthwise slot along one side for receiving an axle shaft and extending generally vertically the full height of the door opening and then horizontally a distance at least equal to the combined side-by-side thickness of a plurality of door sections to be used as a closure in said opening, a second vertical track of generally ovoid section fixed and overlying the slotted side of said first track over its vertical length and extending above said first track a distance less than the width of each door segment and horizontally above and parallel to the horizontal portion of the first track, said second track having lengthwise slots in opposite sides corresponding to and aligned with the slot in the first track over the vertical length of said first track, a slot through the walls of said second track corresponding to the vertical slot in said first track, and a single slot in one side continuing over the balance of the length of said second track in the side remote from the first track, and continuing the vertical slot in the same side, a door component comprising a plurality of upstanding horizontally elongate and normally stacked door sections normally closing said opening, means pivotally attaching adjacent door sections together along successive like horizontal edge portions thereof whereby the door sections remain in a substantially vertical plane from a normal coplanar closure position to a second overhead side-by-side vertical plane storage position, first follower means adjacent the bottom of each door section on each side engageable with the first track means, and second follower means adjacent the top of each door section on each side engageable with the second track means, said first and second follower means being operable to guide said door section from the normal coplanar closure position to the second side-by-side vertical position. Preferably counterbalance means are provided, adjacent the support and guide and operatively connected to at least one of said door segments yieldably urging said door segments toward the second side-by-side vertical position. This counterbalance means is preferably torsion spring loaded retracting means connected to the bottom door section in the normally closed position of the door segments. Preferably the follower means are rollers enclosed in the guide means and rotatable on shafts fixed in the door sections or attached to the door sections by means of clips or carriers. Preferably the means pivotally attaching the door sections together is a lever arm extending from a lever arm guide fixed to the bottom of one door section to a guide fixed to the bottom of the next adjacent door section, said lever arm being pivoted at its two ends in pivotal guide means for rotation from a vertical plane parallel to the plane of the door section in the normal coplanar position to a position generally parallel to the bottom edges of said door section in the vertical side-by-side second position.

In the foregoing general description, I have set out certain objects, purposes and advantages of my invention. Other objects, purposes and advantages of this invention will be apparent from a consideration of the following description and the accompanying drawings in which.

Figure 1:
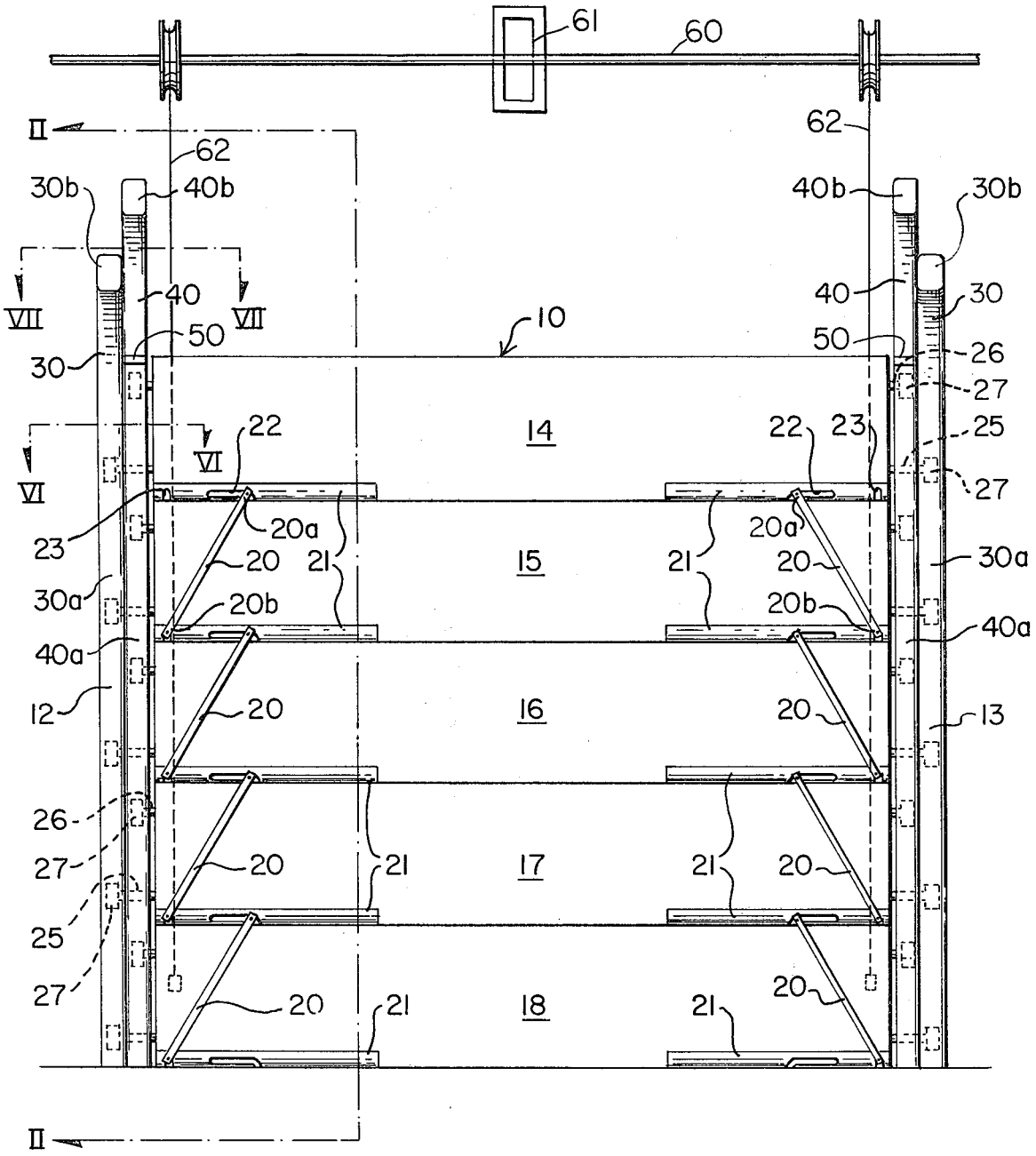
FIG. 1 is a plan elevational view of a door assembly according to this invention, as seen from the inside of the door.
Figure 2:
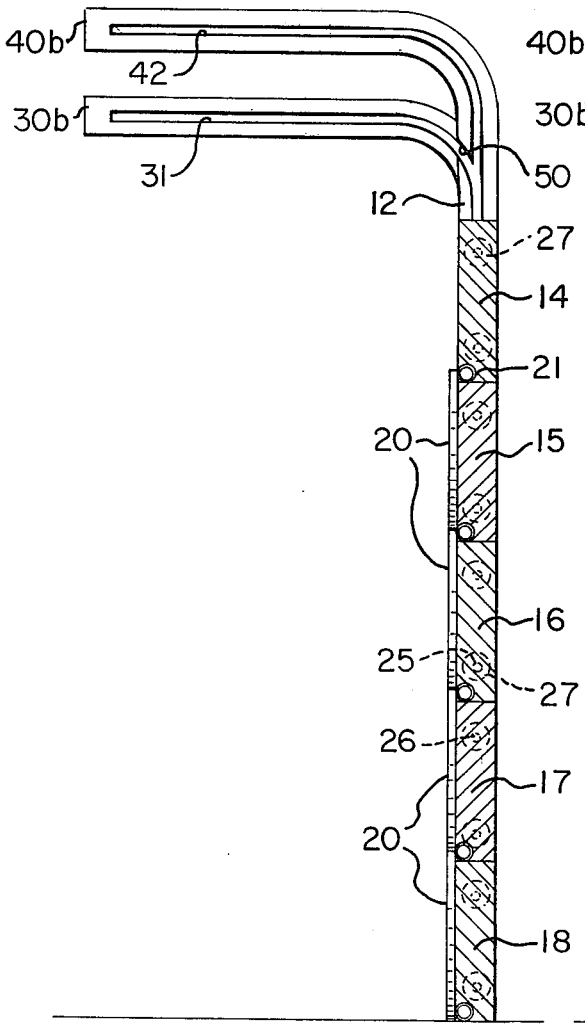
FIG. 2 is a vertical section through door assembly of FIG. 1 on the line II—II of FIG. 1.
Figure 3:
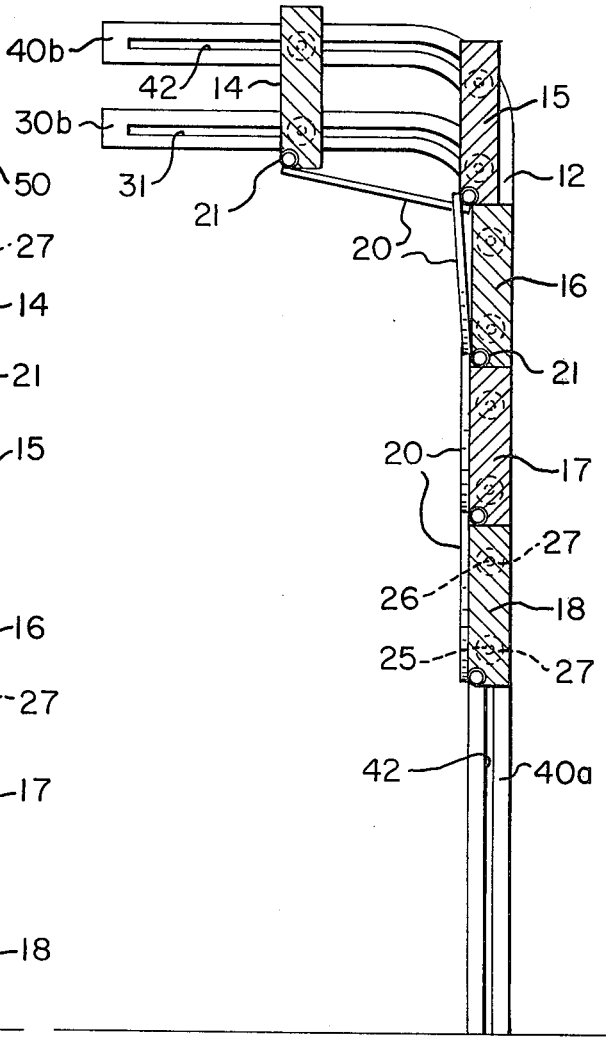
FIG. 3 is a vertical section on the line II—II with the top door section moved into stored position and the second section ready to enter the horizontal storage tracks.

Referring to the drawings I have illustrated a door opening 10. A pair of upstanding support and guide means 12 and 13 are provided on opposite sides of door opening 10. The two support and guide means 12 and 13 are formed in substantially the same manner as mirror images of each other. Since their structure and operation are the same only the left hand support and guide means 12, viewing the interior of the door assembly as illustrated in FIG. 1 will be described in detail.

The door component is made up of a plurality of horizontally elongated and vertically stacked door sections 14, 15, 16, 17, and 18. More or less door sections may be used depending upon the height of the opening 10 to be closed by the sections. Adjacent sections, i.e. 14 and 15, 15 and 16, 16 and 17 and 17 and 18 are connected together at their bottom corners by lever arms 20 pivotally connected to a lever arm guide 21 at each bottom corner of each section. Each lever arm guide is provided with a first guide slot 22 which extends lengthwise of the door in a plane substantially parallel to the plane of the door section lower edge or bottom over a major portion of its length, then generally vertically upwardly and finally lengthwise of the door section in a plane substantially parallel to the vertical plane of the door section. A second guide slot 23 is also provided in each lever arm guide 21 adjacent one end of slot 22. This second guide slot 23 extends from a plane substantially parallel to the lower edge of the door section to a plane substantially parallel to the vertical plane of the door section. One end **20*a* of each lever arm 20 is connected to first guide slot 22 in lever arm guide 21 on the bottom of one door section. The other end 20*b* of each lever arm 20 is connected to the second guide slot 23 in lever arm guide 21** on the bottom of the next adjacent door section.

Each door section 14, 15, 16, 17 and 18 is provided with shafts 25 adjacent the bottom of each end and shafts 26 adjacent the top of each end. Shafts 25 are longer than shafts 26 for reasons which will be better understood from the description of their relation to the support of guides hereafter set out. Each shaft 25 and 26 carries a guide roller 27.

The support and guide means 12 is made up of two generally oval section trackways 30 and 40 connected in superimposed position. The trackway 30 remote from the door component is provided with a vertical leg **30*a* which extends to a point adjacent the top of opening 10 and then curves into a horizontal section 30*b* which runs transverse to vertical leg 30*a* at the level of the top of opening 10. Trackway 30 has a slot 31 extending its full length. Trackway 40 nearest the door component is provided with a vertical leg 40*a* which overlies the vertical leg 30*a* of trackway 30 and continues above trackway 30 a distance equal to the distance between roller shafts 25 and 26 where it curves into a horizontal section 40*b* parallel to and above horizontal section 30*b* of trackway 30. Trackway 40 has parallel slots 41 and 42 in two walls corresponding to slot 31 over the vertical length of slot 31. Trackway 40 is fixed to trackway 30 by welding or the like along the vertical length of trackway 30. Slot 42 continues over the full length of trackway 40. A slot 50, which is the same width as slots 31 to permit shaft 25 of roller 37 to pass from slots 41 and 42, is cut in the wall of trackway 40 corresponding to slot 31 from vertical leg 30*a* into the curved part of trackway 30 leading to the horizontal portion 30*b*. The guide rollers 27 on shafts 26 run in trackway 40 with shafts running in slot 42. Shafts 25 extend through slots 41 and 42 and through slot 31 into the interior of trackway 30 where guide roller 27 on the end of shafts 25 run in trackway 30**.

Counterbalance or lift means are provided for raising or assisting in raising the weight of the several door sections from the closure position to the stacked position. In the drawings this is an elongate shaft 60 above the opening 10, a torsion spring 61 which rotates shaft 60 in one direction and a cable 62 at each end of the shaft which connects to the bottom section 18 of the multi section door. In this arrangement the torsion spring 61 acts on shaft 60 to rotate it and to exert lifting pressure on the door section through cables 62, to assist in raising the sections to their stored position.

In operation, the door sections 14–19 in the coplanar closure position shown in FIG. 1 close opening 10. To open the opening 10 the door sections are lifted vertically in trackways 12 and 13. Rollers 27 on shafts 26 adjacent the top of the uppermost door section follow trackway 40 vertically upwardly. At the same time rollers 27 on shafts 25 adjacent the bottom of the same door section follow trackway 30 vertically upwardly as the rollers reach the end of the vertical legs **30*a* and 40*a* they follow the curved section of trackway onto horizontal portions 40*b* and 30*b* respectively. As the bottom rollers 27 of one section enter the curved portion of track 30, the top rollers 27 of the next adjacent section pass slot 50 and go upwardly in trackway 40 until they are in spaced apart parallel position. At the same time the ends of lever arms 20 move in guide slots 22 and 23 on the two adjacent panels from a vertical to a horizontal position connecting the bottoms of the two panels. As the panels are moved together on horizontal track portion 30*b* and 40*b* to a side-by-side stored positions, one end of lever arm in slot 22** will move lengthwise of the slot along the bottom of the door section until it takes a position generally parallel to the bottom edges of the adjacent door sections. In this operation the door sections do not change their vertical position and thus are fully supported by their width against any bending contrary to the situation where the panels are rotated to flat horizontal plane as in all other doors known to applicant.

Figure 4:
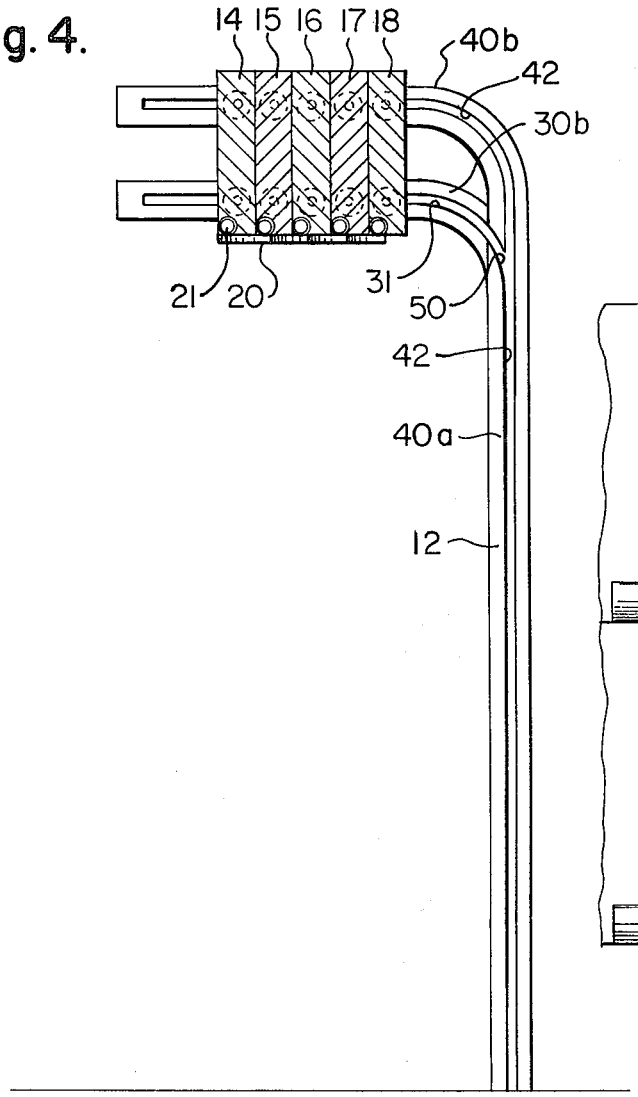
FIG. 4 is a vertical section on the line II—II with all door sections stored in the horizontal storage tracks.
Figure 5:
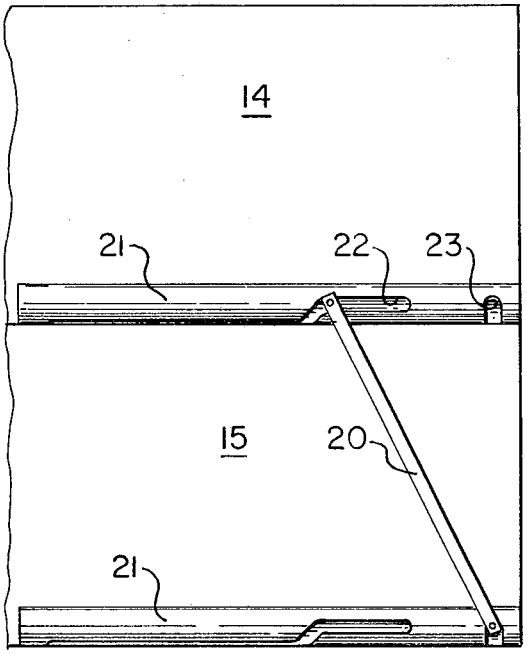
FIG. 5 is an enlarged fragmentary elevational view of the inner side of two adjacent superimposed door sections in the closed position showing the connection means in position.
Figure 6:
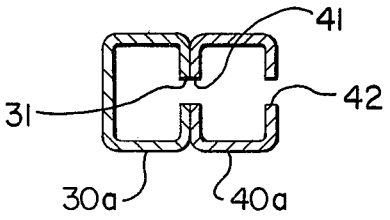
FIG. 6 is a fragmentary section on the line VI—VI through the vertical track of FIG. 1.
Figure 7:
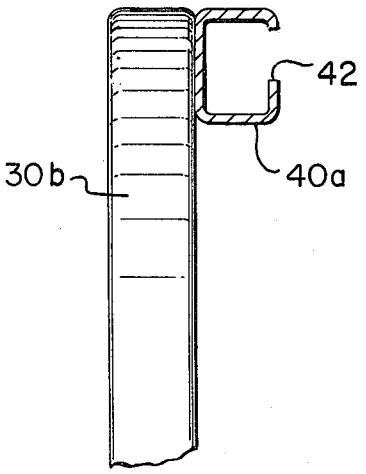
FIG. 7 is a fragmentary section on the line VII—VII through the track of FIG. 1.
Figure 8:
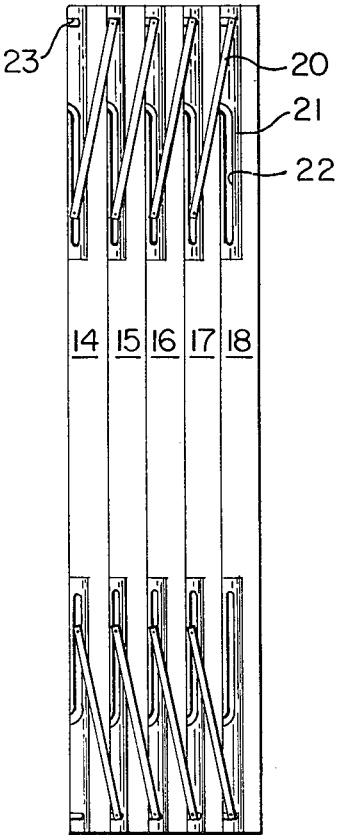
FIG. 8 is a bottom plan view of the door sections in the raised stored position.
Figure 9:
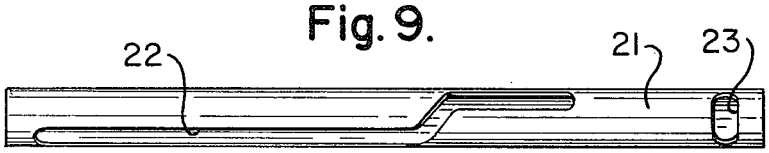
FIG. 9 is an enlarged plan view of one of the lever arm guides used in a preferred embodiment of this invention.
Figure 10:
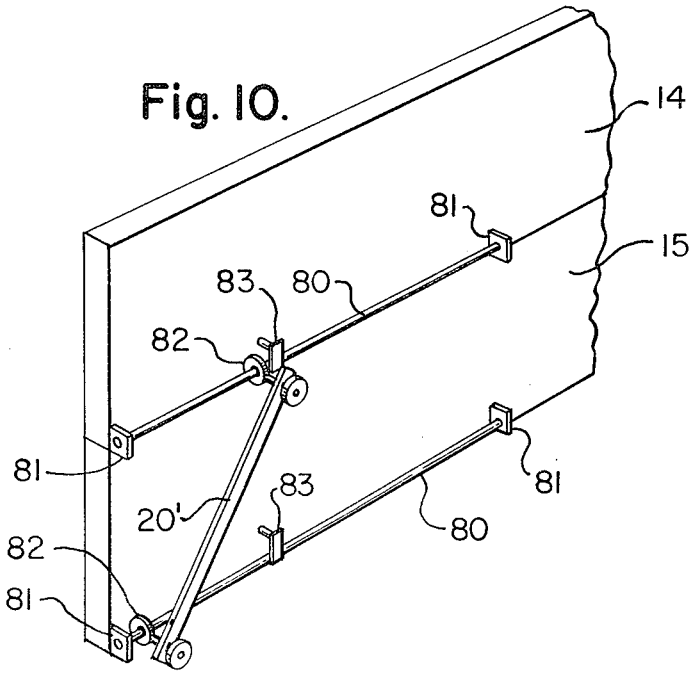
FIG. 10 is an enlarged plan view of a second embodiment of lever arm guide usable in this invention.

In FIG. 10 I have illustrated a second embodiment of lever arm guide usable in this invention. In this embodiment a rod 80 is attached at each end to brackets 81 on the bottom of each side of each door section. The lever arm 20' is provided at each end with pivotal eyes 82 slidable on rods 80 on to adjacent doors. A one way clip or keeper 83 is fixed on each door section to overly the top and side of rod 80 leaving the bottom exposed. In operation the lever arm 20', when the doors are in coplanar closure position, is in position with the eyes 82 both on the right side of keeper 83, viewing FIG. 10 and the right hand bottom corner of each door section in FIG. 1. On the left hand side of the door sections it will be in the mirror image position, i.e. on the left. When the door sections are moved to the overhead stored position, lever arm 20' moves to a position beneath the bottom of the door and clear of keeper 83 and free to run the full length of rod 80 as the door sections are moved together into side-by-side stored relation as in FIG. 4.

In the foregoing specification I have set out certain preferred practices and embodiments of this invention, however, it will be understood that this invention may be otherwise embodied within the scope of the following claims.

I claim:

1. A folding overhead door assembly comprising opposite side support and guide means defining a door opening between them, said guide means including a pair of side-by-side channel members extending the height of the door opening on each side thereof and thereafter horizontally one spaced above the other, passage means between said two channels over their side-by-side length, a door component comprising a plurality of upstanding elongate, normally coplanar vertically stacked door sections normally closing said opening, means pivotally attaching adjacent door sections together along successive like horizontal edges, follower means at the top and bottom of each end of each door section, one at the top engaged in said one of said pair of channels extending horizontally above the other and the other in the other of said channels, said follower means being operable to guide door sections between the normally coplanar vertical position in the side-by-side channels and an overhead side-by-side vertical position in the one above the other channel portions, each door section all the while remaining in a substantially vertical position, wherein the means pivotally attaching the door sections together is a lever arm extending from a lever arm guide fixed to the bottom of one door section to a guide fixed to the bottom of the next adjacent door section said lever arm being pivoted at its ends in the lever arm guides of two adjacent door sections for rotation between a vertical plane parallel to the plane of the door sections to a position generally parallel to the bottom edges of two adjacent sections connected thereby in the vertical side-by-side position.

2. A folding overhead door assembly comprising opposite side support and guide means defining a door opening therebetween, said side support and guide means including a first track of generally ovoid shape having a lengthwise slot along one side for receiving an axle shaft, said first track having a vertical leg extending substantially the full length of said door opening and then generally horizontally a distance at least equal to the combined side-by-side thickness of a plurality of door sections to be used as a closure in said opening, a second vertical track of generally ovoid section fixed to and overlying the vertical leg of said first track on its side carrying the slot, a slot through the opposite walls of said second track corresponding to the vertical slot in said first track, a single slot in one side of said second track in the side remote from the first track over the balance of the length of said second track, said second track continuing vertically and then horizontally above and generally parallel to the first track a distance substantially equal to the width of the door sections used to form a closure, a door component comprising a plurality of upstanding elongate and normally coplanar stacked door sections normally closing said opening, means pivotally attaching adjacent door sections together along successive like horizontal edge portions thereof whereby the individual door sections remain in a substantially vertical plane from a normal coplanar vertical closure position in a top to bottom position one with the other to a second overhead side-by-side vertical plane all the while remaining in a substantially vertical plane, first follower means adjacent the bottom of each door section on each side engageable with the first track means and second follower means adjacent the top of each door section on each side engageable with the second track means, said first and second follower means being operable to guide said door section from the normally coplanar vertical closure position to the second side-by-side vertical position all the while remaining in a substantially vertical position and wherein the means pivotally attaching the door sections together is a lever arm extending from a lever arm guide fixed to the bottom of one door section to a guide fixed to the bottom of the next adjacent door section, said lever arm being pivoted at its ends in the lever arm guides of two adjacent door sections for rotation between a vertical plane parallel to the plane of the door sections to a position generally parallel to the bottom edges of two adjacent sections connected thereby in the vertical side-by-side position.

3. A folding overhead door assembly as claimed in claim 2 wherein counterbalance means are operatively connected to at least one of said door sections yieldably urging said door sections toward the second side-by-side vertical position.

4. A folding overhead door assembly as claimed in claim 3 wherein the counterbalance means is a torsion spring.

5. A folding overhead door as claimed in claim 2 wherein the follower means are rollers enclosed in the ovoid guide means and rotatable on shafts fixed on the door sections at top and bottom of each side.

6. A folding overhead door assembly as claimed in claim 1 wherein counterbalance means are operatively connected to at least one of said door sections yieldably urging said door sections toward the side-by-side position.

7. A folding overhead door assembly as claimed in claim 6 wherein the counterbalance means is a torsion spring.

8. A folding overhead door as claimed in claim 1 wherein the follower means are rollers operating in said channels and rotatable on shafts fixed on the door sections.

* * * * *